US007994743B2

(12) United States Patent
Albrecht et al.

(10) Patent No.: US 7,994,743 B2
(45) Date of Patent: Aug. 9, 2011

(54) DEVICE FOR MOVING A FIRST FURNITURE PART RELATIVE TO A SECOND FURNITURE PART, AND A PIECE OF FURNITURE

(75) Inventors: Markus Albrecht, Lustenau (AT); Joerg Janzen, Feldkiech (AT); Holger Wenzel, Lindau (DE)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 374 days.

(21) Appl. No.: 12/243,158

(22) Filed: Oct. 1, 2008

(65) Prior Publication Data

US 2009/0083940 A1 Apr. 2, 2009

Related U.S. Application Data

(63) Continuation of application No. PCT/EP2007/003030, filed on Apr. 4, 2007.

(30) Foreign Application Priority Data

Apr. 4, 2006 (DE) ..... 20 2006 005 578 U

(51) Int. Cl.
*H02P 1/00* (2006.01)

(52) U.S. Cl. ..... 318/266; 318/286; 318/280

(58) Field of Classification Search ..... 318/286, 318/280, 266, 466
See application file for complete search history.

(56) References Cited

U.S. PATENT DOCUMENTS

| | | | | |
|---|---|---|---|---|
| 5,795,044 | A * | 8/1998 | Trewhella et al. | 312/333 |
| 5,801,502 | A * | 9/1998 | Monzen | 318/286 |
| 6,685,288 | B1 | 2/2004 | MacMillan | |
| 2004/0104649 | A1 * | 6/2004 | Muller et al. | 312/333 |
| 2005/0248247 | A1 * | 11/2005 | Huang | 312/334.47 |

FOREIGN PATENT DOCUMENTS

| | | | |
|---|---|---|---|
| AT | 007 723 | U1 | 6/2005 |
| DE | 43 24 846 | A1 | 1/1995 |
| DE | 198 21 014 | A1 | 11/1999 |
| DE | 101 05 756 | A1 | 8/2001 |
| DE | 203 08 256 | U1 | 6/2004 |
| DE | 20 2004 007 170 | U1 | 9/2004 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 362 | A2 | 7/2003 |
| EP | 1 323 363 | A1 | 7/2003 |

(Continued)

*Primary Examiner* — Karen Masih
(74) *Attorney, Agent, or Firm* — Burr & Brown

(57) ABSTRACT

A device is proposed for moving a first furniture part relative to a second furniture part, using a drive unit, by means of which the first furniture part, can be moved in a driven manner relative to the second furniture part via a monitoring unit for monitoring the movement of the first furniture part. According to the invention, the monitoring unit is designed to render the automatic closing inoperative for positioning the first furniture part, in an open position, from which the first furniture part, returns automatically to a closed position after a predetermined closing time interval.

8 Claims, 1 Drawing Sheet

FOREIGN PATENT DOCUMENTS

| | | | |
|---|---|---|---|
| EP | 1 323 364 | A1 | 7/2003 |
| EP | 1 374 732 | A1 | 1/2004 |
| GB | 2 374 521 | A | 10/2002 |
| WO | 2004/100717 | A1 | 11/2004 |
| WO | 2004/100718 | A1 | 11/2004 |
| WO | 2005/058092 | A1 | 6/2005 |

* cited by examiner

DEVICE FOR MOVING A FIRST FURNITURE PART RELATIVE TO A SECOND FURNITURE PART, AND A PIECE OF FURNITURE

CROSS REFERENCE TO RELATED APPLICATIONS

This application is a continuation of International Application No. PCT/EP2007/003030, filed Apr. 4, 2007, which designated the United States, and claims the benefit under 35 USC §119(a)-(d) of German Application No. 20 2006 005 578.9 filed Apr. 4, 2006, the entireties of which are incorporated herein by reference.

FIELD OF THE INVENTION

The invention relates to a device for moving a first furniture part relative to a second furniture part, and to a piece of furniture including the device.

BACKGROUND OF THE INVENTION

Devices for moving a first furniture part relative to a second furniture part using a drive unit have already been disclosed in many embodiments from the prior art. An arrangement with a movable furniture part in the form of a drawer is disclosed, for example, in European Patent Application 1 323 362 A1. The arrangement comprises a drive unit for the drawer, and a control device for controlling the drive unit.

German Laid-Open Specification 198 21 014 A1 discloses a device for opening a closure element, such as a drawer, a door, or a flap by means of a drive unit. A device which can be operated easily is created by this device having a drive unit and an initiation element, with the closure element including the initiation element and the initiation element being designed such that, when it is touched, it produces a signal by means of which the drive unit is operated indirectly or directly.

SUMMARY OF THE INVENTION

The invention is based on the object of providing a device for moving a first furniture part relative to a second furniture part using a drive unit which has better control functionality than the prior art.

The invention is based on a device for moving a first furniture part relative to a second furniture part using a drive unit, by means of which the first furniture part can be moved in a driven manner relative to the second furniture part via a monitoring unit for monitoring the movement of the first furniture part. According to the invention, the monitoring unit is designed to render inoperative the automatic closing of a first furniture part from an open position to a closed position after a predetermined closing time interval. This procedure is based on the recognition that, in certain applications it is disadvantageous for the first furniture part to be closed automatically. For example, it is undesirable for a driven drawer to be closed automatically when the user wishes to leave the drawer open for a relatively long time in order, for example, to tidy up, to empty it or to clean it. The process of rendering inoperative can in this case be carried out by a preset program procedure, for example with a time reference. This means that it is feasible for the automatic closing never to take place at a predetermined time of day when, for example, a cleaner is working. It is likewise possible for the automatic closing to be rendered inoperative by means of a control action.

In one preferred embodiment of the invention, the monitoring unit is designed to render the automatic closing inoperative by means of a control action within the predetermined closing time interval, after positioning the first furniture part in an open position from which the first furniture part returns automatically to a closed position after a predetermined closing time interval. It is thus possible, for example, to leave an open drawer in its open position when required, by means of an individual control action shortly after opening. If the furniture part, for example, the drawer is then moved by a manual initiation action to the closed state, the monitoring unit is preferably designed such that this once again neutralizes the rendering of the automatic closing inoperative. The furniture part is therefore automatically moved back to the closed state again when the next opening movement is initiated.

In a further preferred embodiment of the invention, a monitoring unit is provided in which the monitoring unit is designed to render the movement back to the closed position within the predetermined closing time interval inoperative when the first furniture part is moved manually, before the closing time interval has elapsed, from the open position through a predetermined movement distance to a further open position. By way of example, the movable furniture part is moved to an open position which is located a short movement distance in front of the maximum possible open position. The automatic closing process is then not initiated by the manual opening of the furniture part to the maximum possible open position. By way of example, this can be achieved in the case of a drawer in such a way that the drawer opens automatically to a position a few millimeters short of the maximum possible open position, with the maximum possible open position preferably being limited by a mechanical stop. The automatic closing is rendered inoperative by pulling the drawer open to the mechanical stop.

The process of rendering the automatic closing inoperative can also be carried out by other mechanical and/or electrical locks. For example, one possibility is an additional keypad on which appropriate commands are entered, or a remote control which provides such a functionality. The functionality can likewise be provided by a switch, possibly a main power switch.

It is also preferable for the monitoring unit to be designed such that the first furniture part can be left in the maximum possible open position in the absence of any further manual action at that point. This ensures that the furniture part remains in the open position until an operator initiates the movement back to another position, for example to a closed position. As an alternative to this, the monitoring unit can be designed to preset a movement of the first furniture part from the further open position to a third position after a time interval which is greater by a multiple than the predetermined closing time interval. The third position is preferably the closed position. This procedure avoids furniture parts, in particular a drawer, from inadvertently being left open for a long time. For example, the furniture part is preferably closed by moving it to another position after a period, for example, of 15 minutes has elapsed, even though the automatic closing has been rendered inoperative.

The monitoring unit may, for example, be a microcontroller which contains the monitoring device for monitoring and controlling the movement of the first furniture part. It may be integrated in the drive, which allows it to be produced at low cost (mass-produced item), and can be programmed for the existing furniture closure system.

The invention also relates to a piece of furniture having furniture parts which can be moved relative to one another and which comprises one of the above-mentioned devices. The advantages which can be achieved by the respective device can therefore be achieved for a piece of furniture having furniture parts which can be moved relative to one another. In particular, the pieces of furniture comprise movable furniture parts such as drawers, doors, flaps and the like which are guided such that they can move via suitable guide devices on a second furniture part, for example, a furniture housing. In particular, guide rails may be used as guide devices for drawers, and fittings or hinges, in particular, may be used for doors or flaps.

BRIEF DESCRIPTION OF THE DRAWINGS

Two exemplary embodiments of the invention will be explained in more detail in the following text, indicating further advantages and details, and are illustrated in the drawings.

DETAILED DESCRIPTION OF THE INVENTION

Figure 1:
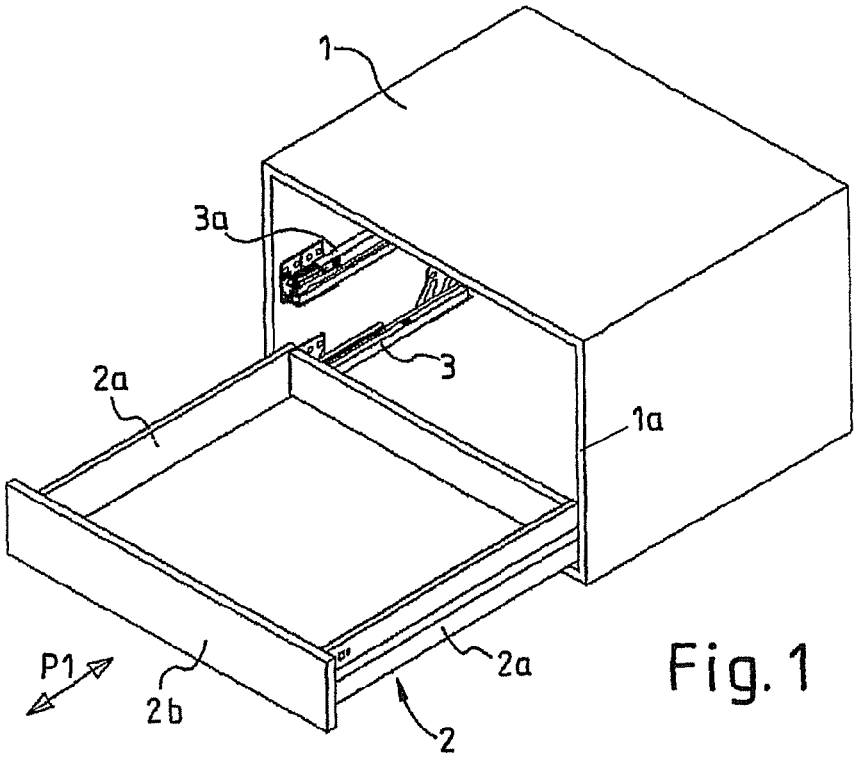
FIG. 1 shows a perspective view of a housing in which a drawer having a device according to the invention is arranged.

FIG. 1 shows, obliquely from above, a piece of furniture which comprises a housing 1 and a drawer 2 which is driven such that it can move therein. The drawer 2, which is arranged in the lower area of the housing 1, is illustrated in the open or moved-out state. The furniture parts 1 and 2 can be moved relative to one another via a pulling-out fitting 3 which is operated by a drive (shown in FIG. 2). A further drawer (not shown) for a further drawer guide 3*a* is accommodated in the same way in the housing 1. The drawer 2 can be moved relative to the housing 1 as indicated by the double-headed arrow P1. The drawer guides 3, 3*a* are connected to side drawer frames 2*a* in order to hold or guide the movement of the drawer 2. Drives preferably act directly on the drawer guides 3, 3*a*. However, it is likewise feasible for a drive to act on the drawer itself, in this case on the drawer rear face, as illustrated symbolically in FIG. 2. A conventional drawer guide 3 can then be used.

After it has been driven to an open position, the drawer 2 is locked in this position, but is automatically moved back to the closed state after a predetermined closing time interval has elapsed. For this purpose, the drawer 2 is preferably first of all pulled against an end face 1*a* of housing 1 and is then positioned at a short distance before the end face 1*a*, thus resulting in a gap between a rear face of the drawer front 2*b* and the end face 1*a*.

Figure 2:
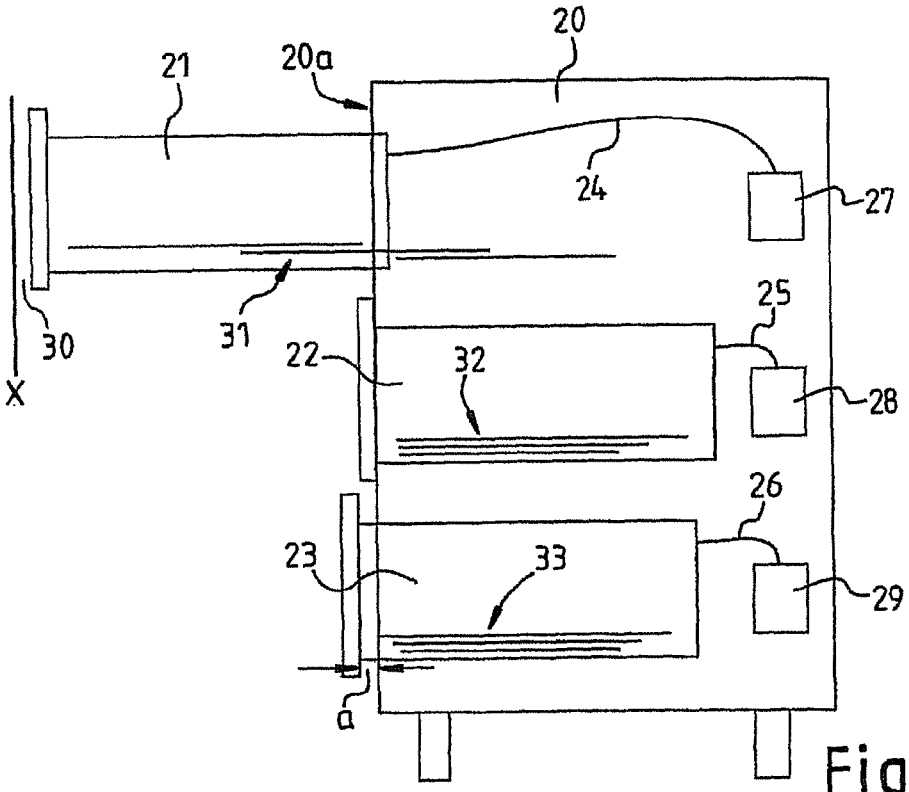
FIG. 2 shows a highly schematic side view of a further exemplary embodiment of a housing having three drawers which are driven according to the invention.

This process is illustrated in FIG. 2. In this exemplary embodiment, drawers 21, 22, 23 are arranged in a housing 20. The drawer 22 has been pushed completely against an end face 20*a* of the housing 20, with the actual closed position being defined at a distance somewhat away from the end face 20*a*, as illustrated by the drawer 23. The closed position may, however, also be defined by the contact of the respective drawer 21, 22, 23 on the end face 20*a*.

The drawers 21, 22, 23 are driven via drive elements 24, 25, 26, which are pulling-pushing cables, for example, and electric motors 27, 28, 29. The drawers are preferably driven into a movement range between an open position and a closed position. The open position is preferably defined such that it is short of a maximum possible open position X by a distance 30. The maximum possible open position X is advantageously defined by a mechanical stop for the drawer guides 31, 32, 33.

The normal procedure is as follows:

The drawer, for example drawer 21, is automatically moved by an initiation action by an operator to an "X—distance 30" position. If the operator does not carry out any further control action, for example manual tapping, the drawer 21 automatically moves, after a closing time interval of, for example, 10 seconds, to a closed state, corresponding to the position of the drawer 22 or 23. If, in contrast, an operator pulls the drawer 21 further out beyond the "X—distance 30" position, possibly as far as the mechanical stop at the point X, the automatic closing procedure is rendered inoperative, and the drawer is in a locked-open position. The drawer 21 preferably remains there until it is manually pushed in the direction of the closed position by an operator. When the drawer is in the locked-open position, work such as cleaning, tidying up, emptying or other processes which take a relatively long time can be carried out without an operator being disturbed by the drawer being closed automatically.

The process of rendering the automatic closing inoperative can also be carried out by other control actions which need not necessarily be performed within the predetermined conventional closing time interval. However, these are preferably manual control actions by an operator from the outside.

It is also feasible in principle for the automatic closing to be rendered inoperative in a manner defined in advance of a monitoring unit operation, for example, during a predetermined time period. However, such internal parameters of the monitoring unit can preferably be changed.

LIST OF REFERENCE SYMBOLS

1 Housing
1*a* End face of 1
2 Drawer
2*a* Drawer front
3 Drawer guide
3*a* Drawer guide
20 Housing
20*a* End face of 20
21 Drawer
22 Drawer
23 Drawer
24 Drive elements
25 Drive elements
26 Drive elements
27 Electric motors
28 Electric motors
29 Electric motors
30 Movement distance
31 Guide
32 Guide
33 Guide
X Maximum possible open position

We claim:

1. A device for moving a first furniture part relative to a second furniture part, comprising a drive unit to move the first furniture part relative to the second furniture part, and a monitoring unit for monitoring the movement of the first furniture part the first furniture part as it returns automatically from an open position to a closed position after a predetermined closing time interval, wherein the monitoring unit renders inoperative the automatic movement of the first furniture part back to the closed position in response to a manual action on the first furniture part within the predetermined closing time interval.

2. The device as claimed in claim 1, wherein the manual action includes moving the first furniture part from the open position through a predetermined movement distance to a further open position.

3. The device as claimed in claim 2, wherein the monitoring unit maintains the first furniture part in the further open position in the absence of any further manual action at that point.

4. The device as claimed in claim 2, wherein the monitoring unit is preset to move the first furniture part from the further open position to a third position after a time interval which is greater by a multiple than the predetermined closing time interval.

5. The device as claimed in claim 1, wherein the automatic movement of the first furniture part is also rendered inoperative by one of a mechanical lock and an electrical lock.

6. The device as claimed in claim 1, wherein the monitoring unit presets the open position of the first furniture part at a predetermined distance short of a maximum possible open position of the first furniture part, which is defined by a mechanical stop.

7. The device as claimed in claim 1, wherein the monitoring unit prevents movement of the first furniture part back to the closed position when the first furniture part is manually moved to a maximum possible open position, which is defined by a mechanical stop.

8. A piece of furniture comprising the device as claimed in claim 1.

* * * * *